US008358187B2

(12) United States Patent
Becerra et al.

(10) Patent No.: US 8,358,187 B2
(45) Date of Patent: Jan. 22, 2013

(54) THERMALLY INDEPENDENT OVERCURRENT TRIPPING DEVICE

(75) Inventors: Marley Becerra, Västerås (SE); Stefan Valdemarsson, Lidköping (SE); Henrik Breder, Västerås (SE)

(73) Assignee: ABB AG, Mannheim (DE)

( * ) Notice: Subject to any disclaimer, the term of this patent is extended or adjusted under 35 U.S.C. 154(b) by 0 days.

(21) Appl. No.: 13/296,733

(22) Filed: Nov. 15, 2011

(65) Prior Publication Data

US 2012/0119855 A1 May 17, 2012

Related U.S. Application Data

(63) Continuation of application No. PCT/EP2010/003045, filed on May 19, 2010.

(30) Foreign Application Priority Data

May 19, 2009 (EP) ..... 09006745

(51) Int. Cl.
*H01H 75/10* (2006.01)

(52) U.S. Cl. ..... 335/39; 335/16

(58) Field of Classification Search ..... 335/16, 335/147, 195

See application file for complete search history.

(56) References Cited

U.S. PATENT DOCUMENTS

| | | | | |
|---|---|---|---|---|
| 3,036,248 | A | 5/1962 | Nellist | |
| 3,252,053 | A | 5/1966 | Paddison | |
| 3,343,039 | A | 9/1967 | Felton | |
| 4,117,285 | A * | 9/1978 | Harper | 200/401 |
| 4,237,436 | A * | 12/1980 | Setescak | 335/63 |
| 4,644,312 | A * | 2/1987 | Baines et al. | 335/236 |
| 5,029,301 | A * | 7/1991 | Nebon et al. | 335/16 |
| 5,381,121 | A * | 1/1995 | Peter et al. | 335/20 |
| 7,463,989 | B2 * | 12/2008 | Butland et al. | 702/66 |

FOREIGN PATENT DOCUMENTS

| | | | |
|---|---|---|---|
| DE | 102005020215 | A1 | 11/2006 |
| GB | 896124 | A | 5/1962 |
| GB | 1062623 | A | 3/1967 |

OTHER PUBLICATIONS

International Search Report (PCT/ISA/210) issued on Jul. 9, 2010, by European Patent Office as the International Searching Authority for International Application No. PCT/EP2010/003045.

European Search Report issued on Sep. 24, 2009, by European Patent Office for European Application No. 09006745.

* cited by examiner

*Primary Examiner* — Elvin G Enad
*Assistant Examiner* — Lisa Homza
(74) *Attorney, Agent, or Firm* — Buchanan Ingersoll & Rooney, P.C.

(57) ABSTRACT

Exemplary embodiments are directed to an electrical overcurrent tripping device for a circuit breaker. The tripping device includes an actuating member which in case of an overcurrent is driven to interact directly or indirectly with a movable contact piece of the circuit breaker to open a contact point in the circuit breaker if the overcurrent is exceeding a preset tripping threshold for a predetermined tripping delay time. The actuating member is coupled to a magnetic circuit such that the driving force acting on the actuating member is created by the magnetic field of the magnetic circuit, said magnetic field being induced by the overcurrent. The actuating member is coupled to an electromagnetic damping arrangement to set the tripping delay time, and is connected to a coupling spring configured to adjust the overcurrent tripping threshold.

11 Claims, 2 Drawing Sheets

THERMALLY INDEPENDENT OVERCURRENT TRIPPING DEVICE

RELATED APPLICATION(S)

Figure 1:
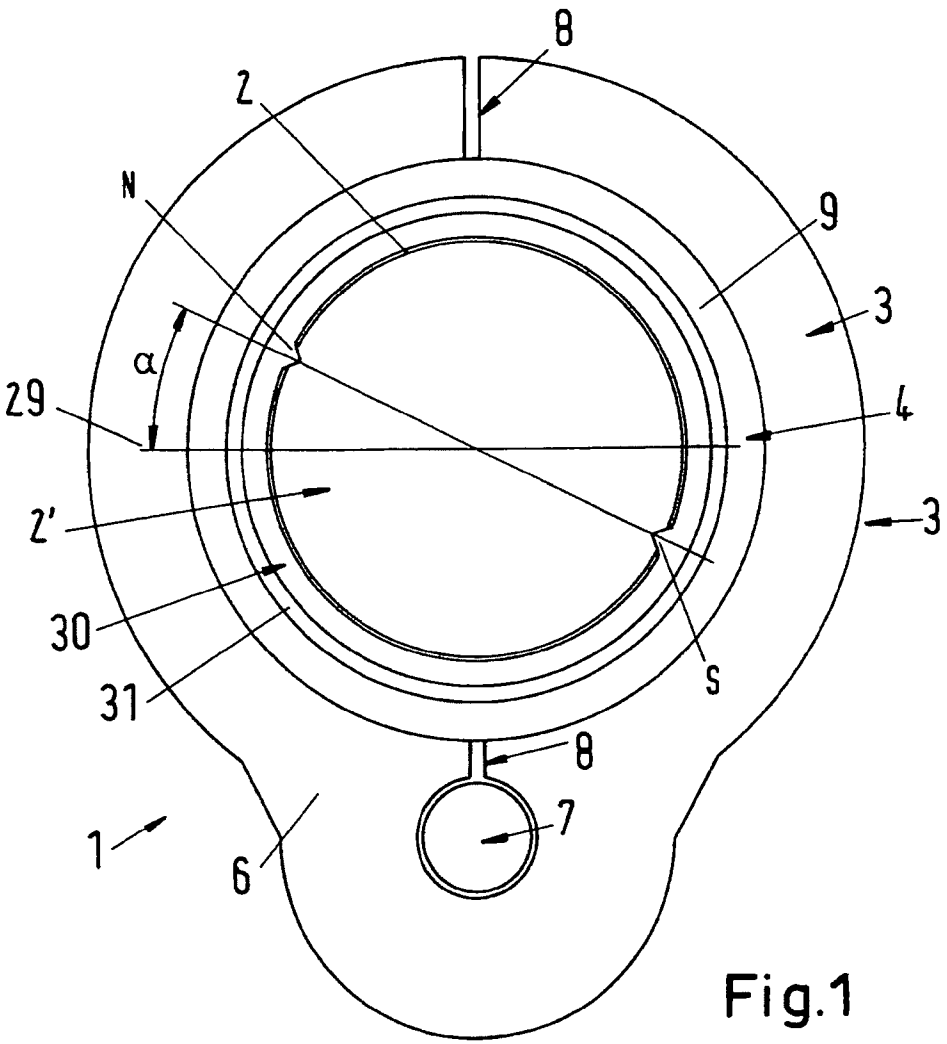

This application claims priority as a continuation application under 35 U.S.C. §120 to PCT/EP2010/003045, which was filed as an International Application on May 19, 2010, designating the U.S., and which claims priority to European Application 09006745.5 filed in Europe on May 19, 2009. The entire contents of these applications are hereby incorporated by reference in their entireties.

FIELD

The disclosure relates to circuit breakers, such as an electrical overcurrent tripping device for a circuit breaker.

BACKGROUND INFORMATION

Known overcurrent trip and installation switching devices of the kind mentioned can be electro mechanical devices. The point of contact can include a fixed contact member and a movable contact member which is held by a movable contact arm or contact bridge. In the closed position the movable contact member is pressed against the fixed contact member influenced by the force of a contact spring.

Known trip devices and installation switching devices can also include a mechanical gear mechanism with a latch and a spring force based energy storage assembly.

Further a known tripping device in the event of a tripping condition acts on the latch, which then releases the energy from the energy storage so that the gear mechanism can act upon the contact lever or contact bridge in order to open the point of contact.

A tripping action of the overcurrent tripping device can be triggered if the current flowing through the installation switching device exceeds the nominal current considerably over a given period of time. The time that has to pass by until a tripping event occurs depends on the strength of the overcurrent. The stronger the overcurrent, the shorter the time until a tripping action occurs. The characteristic dependence between overcurrent and trip time is called the "time invert trip curve". There are standards describing the time invert trip curves, classified in so called trip classes. At an overcurrent which is e.g. 1.5 times the nominal current, for example, can have trip times are between 1 and 10 minutes, for overcurrents 3 times higher than the nominal current trip times are in the range of 2 to 40 seconds, and for overcurrents in the range of 1.1 times the nominal current trip times can be as long as 30 minutes to several hours.

Known overcurrent tripping devices can use metal strips made of a bimetal or a thermal shape memory alloy as an actuating member. The bimetal strip can be heated up by the current flowing, either directly or indirectly, and heating causes the bimetal strip to bend. The thermal properties of the bimetal strip can be designed such that in case of nominal current the bending of the bimetal strip is small enough so that no tripping action occurs. If however an overcurrent flows for some time, the bending becomes large enough to cause an interaction of the bimetal strip, either directly or indirectly via a tripping lever, with the gear mechanism which then causes the contact point to open. Such a device is shown for example in DE 10 2005 020 215 A1.

Such known thermal overcurrent tripping devices suffer from a cross-influence to ambient temperature. Increasing ambient temperature can cause a bending that adds to the current-induced bending and would reduce the tripping threshold if not compensated for. Known solutions for compensating the ambient temperature effect can be based on the application of a second bimetal strip, called compensation bimetal, which is not heated by the current flow but only due to ambient temperature and whose bending direction is opposed to that of the tripping bimetal. The temperature range that can be compensated by such compensation bimetals is however limited.

There are applications where circuit breakers are to be applied in an environment where a high ambient temperature variation might occur, for example up to 70° C., and where the cross-sensitivity of the tripping threshold should be minimal. There are no compensation means known to allow the reliable application of an installation switching device like a circuit breaker in applications with such large variations of ambient temperature.

SUMMARY

An exemplary electrical overcurrent tripping device for a circuit breaker is disclosed, comprising: an actuating member which in case of an overcurrent is driven to interact directly or indirectly with a movable contact piece of the circuit breaker to open a contact point in the circuit breaker if said overcurrent exceeds a preset tripping threshold for a predetermined tripping delay time, wherein said actuating member is coupled to a magnetic circuit whereby the driving force acting on the actuating member is created by the magnetic field of the magnetic circuit, said magnetic field being induced by the overcurrent, that said actuating member is coupled to an electromagnetic damping arrangement to set the tripping delay time, and that said actuating member is connected to a coupling spring for adjusting the overcurrent tripping threshold.

An exemplary circuit breaker with an electrical overcurrent tripping device is disclosed, comprising: at least one contact point with a fixed end, a movable contact piece, wherein said tripping device includes an actuating member which in case of an overcurrent is driven to interact directly or indirectly with the movable contact piece to open the contact point if said overcurrent exceeds a preset tripping threshold for a predetermined tripping delay time, wherein said actuating member is coupled to a magnetic circuit such that the driving force acting on the actuating member is created by the magnetic field of the overcurrent, said actuating member is coupled to an electromagnetic damping arrangement to set the tripping delay time, and said actuating member is connected to a coupling spring configured to adjust the overcurrent tripping threshold.

An exemplary electrical overcurrent tripping device for a circuit breaker, is disclosed, comprising: a magnetic circuit for generating a magnetic field induced by an overcurrent; and an actuating member driven by the magnetic field of the magnetic circuit, wherein said actuating member interacts with a movable contact piece of the circuit breaker to open a contact point in the circuit breaker if the overcurrent exceeds a preset tripping threshold for a predetermined tripping delay time; an electromagnetic damping arrangement coupled to the actuating member to set the tripping delay time; and a coupling spring connected to said actuating member for adjusting the overcurrent tripping threshold.

DETAILED DESCRIPTION OF THE DRAWINGS

Figure 2:
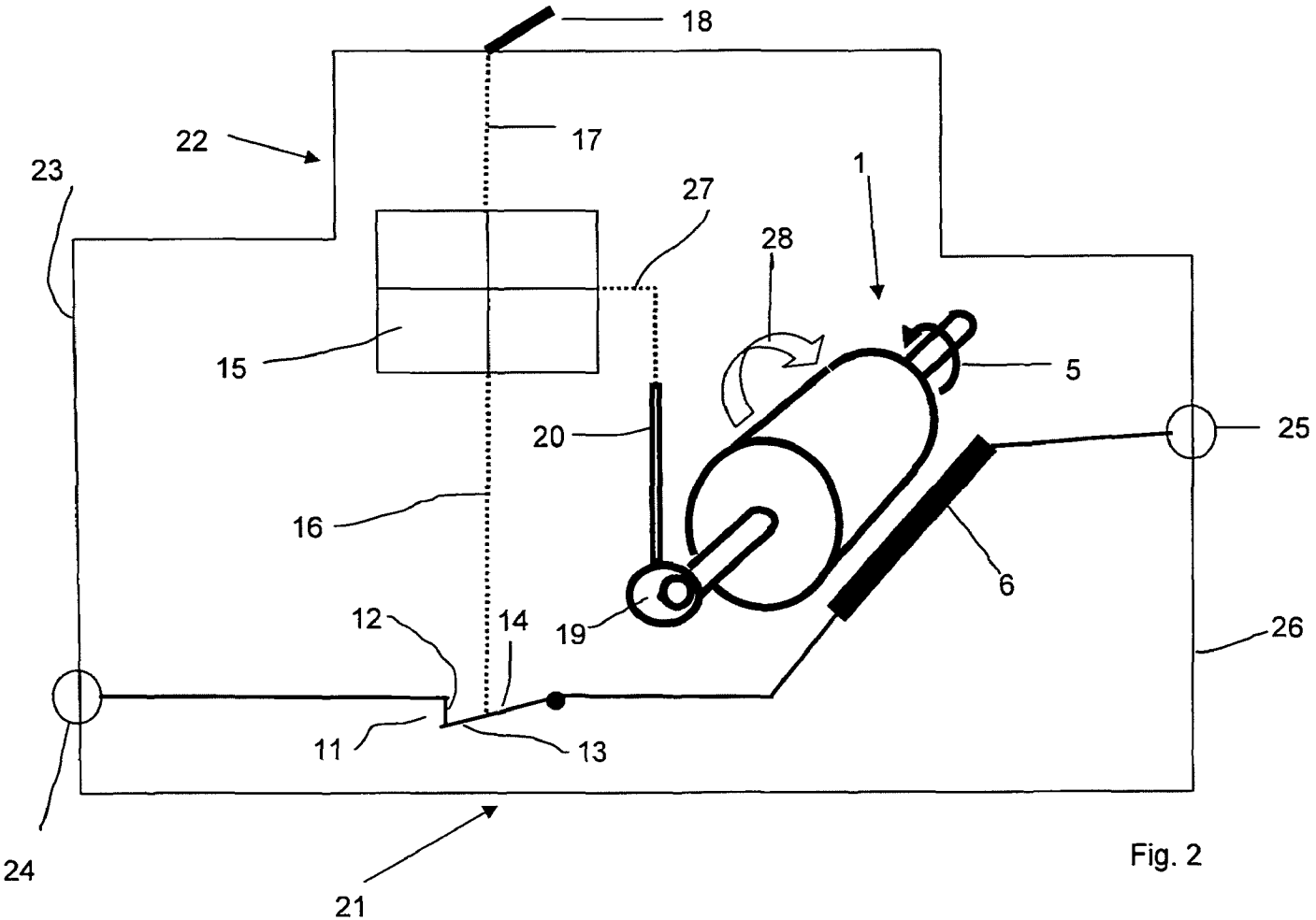

The disclosure will be described in greater detail with reference to the accompanying drawings, wherein FIG. 1 shows a cross-sectional view of an electrical overcurrent tripping device in accordance with an exemplary embodiment of the present disclosure, FIG. 2 shows a schematic view of an installation switching device with an electrical overcurrent tripping device in accordance with an exemplary embodiment of the present disclosure.

Same or similar elements or elements with a similar effect have the same reference numerals.

DETAILED DESCRIPTION

An exemplary embodiment of the present disclosure is directed to providing an overcurrent tripping device with a very low thermal cross-sensitivity to ambient temperature change.

Another exemplary embodiment of the present disclosure is directed to providing an installation switching device with an overcurrent tripping device with a very low thermal cross-sensitivity to ambient temperature change.

In an exemplary embodiment of the present disclosure an actuating member is coupled to a magnetic circuit whereby the driving force acting on the actuating member is created by the magnetic field of the overcurrent, and the actuating member is coupled to an electromagnetic damping arrangement to set the tripping delay time, and the actuating member is connected to a coupling spring configured to adjust the overcurrent tripping threshold.

An advantage of the exemplary embodiments of the present disclosure includes realizing the overcurrent tripping with a magnetic tripping setup, whereby a magnetic tripping device per se has none or only a very small thermal cross-sensitivity. The time invert trip curve is obtained by including an electromagnetically damped actuating member, where the magnetic driving force is created by the load current. Thus the thermo-mechanical behaviour of a bimetal strip when exposed to an overcurrent is more or less reproduced by the combination of electromagnetic damping and coupling to a coupling spring of a magnetic actuator.

Another advantage provided by exemplary embodiments disclosed herein can include the actuating member being an electromagnetically damped rotor in a magnetic circuit where the driving magnetic field is created by the load current.

Still another advantage provided by exemplary embodiments of the present disclosure can include the actuating member being a tubular rotor having a permanent magnet, and the magnetic circuit further including a tubular stator being part of the magnetic core of the magnetic circuit with at least one winding of a conductor embracing the magnetic core and carrying the load current, whereby the stator at least partially embraces the rotor and the rotor is rotatably mounted within the stator.

The driving force provided by the current is countered with a spring force. If the current exceeds a certain value, the overcurrent threshold, then the driving force can overcome the spring counter force and start to rotate the rotor.

Another advantage provided by the exemplary embodiments disclosed herein includes the tubular stator having soft magnetic and highly permeable material. Radially oriented slots can be used further to control the magnetic flux.

Exemplary embodiments of the present disclosure provide another advantage in that the device can include an eddy-current type electromagnetic damping system for the rotor. The eddy current is induced in the fixed body, meaning in the stator or in a part being fixedly connected to the stator.

Still another advantage provided by exemplary embodiments of the present disclosure can include the electromagnetic damping arrangement having a tube made of electrically conductive material which is located in a gap between the tubular stator and the tubular rotor, so that a damping power loss due to eddy-current generated in the tube is induced when the rotor is turning. In an exemplary embodiment, the tube can consist of copper, silver or other material or combinations with high electrical conductivity. The damping power loss and mass inertia should specify time to complete the rotation to a certain angle. This specified time sets the tripping delay time.

The opening of the contact point will be triggered when the rotation has completed to a preset angle after a time interval which is given by the force, the magnetisation, the eddy-current type damping and the mass inertia.

Exemplary embodiment of the present disclosure provides an advantage in that the coupling spring can be coupled to the rotation axis of the tubular rotor.

An exemplary installation switching device of the present disclosure can include an actuating member coupled to a magnetic circuit whereby the driving force acting on the actuating member is created by the magnetic field of the overcurrent, the actuating member is coupled to an electromagnetic damping arrangement to set the tripping delay time, and the actuating member is connected to a coupling spring configured to adjust the overcurrent tripping threshold.

FIG. 1 shows a cross-sectional view of an electrical overcurrent tripping device in accordance with an exemplary embodiment of the present disclosure. As shown in FIG. 1 a tubular stator 6 can be made of a soft magnetic and magnetically highly permeable material, e.g. iron. At its lower border area there is an additional bore in which a conductor 7 is held. The conductor carries the current of the current path. The current creates a magnetic field which inside the tubular stator has a direction substantially parallel to the line 29. The tubular stator 6 has one or several slots 8, oriented in a radial direction. The slots 8 can keep the magnetic flux created by the conductor completely within the iron circuit or magnetic circuit 3 of the stator 6. Inserted into and attached to the inner contour of the iron stator 6 there is a copper tube 9. An actuating member 2, in the form of a tubular rotor 2', for example, can include a permanent magnet, is held inside the inner opening of the tubular stator 6, being rotatably mounted on an axis which is coaxial to the central axis of the tubular stator 6. The tubular rotor 2' can be encased by an aluminium tube 30, for mechanical support and protection. Between the outer contour of the aluminium tube 30 and the inner contour of the copper tube 9 there is an air gap 31. The rotor 2' can be press-fitted into the aluminium tube 30, additionally being fixed by two noses protruding from the aluminium tube 30 and fitting into two grooves N and S in the rotor 2'. The thought line connecting the groves N and S may indicate the orientation of the magnetic field of the permanent magnet included in the rotor 2', but does not have to. As shown in FIG. 1, the magnetic field of the permanent magnet from the rotor 2' and the magnetic field generated by the conductor 7 enclose an angle $\alpha$ for example, between 10° and 40°, and more preferably about 30°.

An increase of the current flow through the conductor 7 increases its magnetic field, resulting in a driving force turning the rotor 2' in a clockwise direction, thus increasing the angle a to a value of between 80° and 120°, for example, and more preferably to substantially 110°. On one side, not shown in FIG. 1, a spring can act on the axis of the rotor 2' applying a retaining torque. Only after the current in the conductor has exceeded a certain threshold value, the torque created by the magnetic field is sufficient to overcome the retaining torque of the spring and rotation of the rotor 2' will start. The rotation of the permanent magnet in the rotor induces eddy-currents in the copper tube 9, which provide damping by generating counteracting magnetic fields. The copper tube 9 in cooperation with the magnetic field of the permanent magnet in the rotor 2' thus forms an electromagnetic damping arrangement 4 for the rotor. The eddy current is thus induced in the stator. The mass inertia of the rotor mass contributes with a second order time integration effect. The described damping effects have as a result that the rotation of the rotor 2' does not happen immediately, but with a delay time.

FIG. 2 shows a schematic view of an installation switching device with an electrical overcurrent tripping device in accordance with an exemplary embodiment of the present disclosure. As shown in FIG. 2, an installation switching device 21, e.g. a circuit breaker, has a housing 22 made of an insulating material. The switching device has on one side 23 a first connection terminal 24 for connection of a conductor, and on the opposite side 26 a second connection terminal 25 for connection of another conductor. A current path is flowing between the two connection terminals 24, 25 through the device 21. A contact point 11 includes a fixed contact piece 12 and a movable contact piece 13, which is mounted on a movable contact lever 14. The device 21 includes a mechanical gear 15 which cooperates along a dotted function line 16 with the movable contact lever for permanent opening of the contact point 11 or closing of the same. The gear 15 can be manually operated by a handle 18 via a dotted function line 17.

An overcurrent trip device 1 as shown and described above in reference to FIG. 1 is located inside the device 21 and part of the current path. The stator 6 is schematically shown as a bold bar, for ease of illustration. The axis of the rotor 2' of the overcurrent tripping device 1 has at its free end an excenter disk 19 or any other angular dependent movement which cooperates with a trip lever 20. The trip lever 20 cooperates (e.g., via a dotted function line 27) with the gear 15 as well. The opposite side of the rotor axis can be coupled to a spring 5 which is schematically shown as an arrow indicating the direction of the spring torque that is bears on the rotor 2'. In the case shown here the spring bears a torque directed in a counterclockwise direction on the rotor axis.

In case of an overcurrent flowing through the device 21, a torque in clockwise direction will be exerted on to the rotor 2'. The damping force due to the electromagnetic damping in the eddy-current tube will exert a counter torque in counter clockwise direction. The arrow 28 in FIG. 2 shows the resulting net torque which is directed in clockwise direction. The excenter disk 19, on clockwise turning lifts the trip lever 20, which on being actuated in such a way by the tripping device 1 (e.g., via a dotted function line 27) interacts with the gear 15 to permanently open the contact point 11.

An advantage provided by exemplary embodiments illustrated in FIGS. 1 and 2 when used as an overcurrent tripping device is that the tripping is independent of thermal cross-sensitivity, because tripping is due to electro magnetic effects as function of the line current.

Finally, the disclosure shall not be limited to the embodiments shown, but each equivalent shall certainly be included within the range of protection of this specification.

For example, the stator could be formed as a single part or as a core assembled from two or more pieces. In another embodiment not shown here, the rotor would not have an aluminium tube. Protection of the permanent magnet could be achieved by other means as well. In yet another embodiment the groves N and S are not at the North and South poles of the permanent magnet of the rotor.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SIGNS

1 overcurrent tripping device
2 actuating member
2' rotor
3 magnetic circuit
4 damping arrangement
5 coupling spring
6 stator
7 conductor
8 slot
9 tube
10 circuit breaker
11 contact point
12 fixed contact piece
13 movable contact piece
14 contact lever
15 mechanical gear
16 dotted function line
17 dotted function line
18 handle
19 excenter disk
20 trip lever
21 circuit breaker
22 housing
23 side
24 connection terminal
25 side
26 connection terminal
27 dotted function line
28 arrow
29 line
30 aluminium tube
31 air gap
32 middle bar
33 lower bar
34 fluxlines
35 solid arrow
36 dotted arrow

What is claimed is:

1. An electrical overcurrent tripping device for a circuit breaker, comprising:

an actuating member which in case of an overcurrent is driven to interact directly or indirectly with a movable contact piece of the circuit breaker to open a contact point in the circuit breaker if said overcurrent exceeds a preset tripping threshold for a predetermined tripping delay time, wherein said actuating member is coupled to a magnetic circuit whereby the driving force acting on the actuating member is created by the magnetic field of the magnetic circuit, said magnetic field being induced by the overcurrent, that said actuating member is coupled to an electromagnetic damping arrangement to set the tripping delay time, and that said actuating member is connected to a coupling spring for adjusting the overcurrent tripping threshold, wherein said actuating member is an electromagnetically damped rotor in a magnetic circuit where the driving magnetic field is created by the load current, wherein said magnetic circuit includes a tubular stator as part of the magnetic core of the magnetic circuit with at least one winding of a conductor embracing the magnetic core and carrying at least partly the load current, and wherein said stator at least partially embraces the rotor and the rotor is rotatably mounted within said stator.

2. The electrical overcurrent tripping device according to claim 1, wherein the tubular stator comprises soft magnetic and highly permeable material, and has radially oriented slots to control the magnetic flux.

3. The electrical overcurrent tripping device according to claim 1, wherein the device comprises an eddy-current type electromagnetic damping system for the rotor.

4. The electrical overcurrent tripping device according to claim 3, wherein the electromagnetic damping arrangement comprises a tube made of electrically conductive material located in a gap between the tubular stator and the tubular rotor, so that a damping power loss due to eddy-current generated in the tube is induced when the rotor is turning.

5. The electrical overcurrent tripping device according to claim 3, wherein the coupling spring is coupled to the rotation axis of the tubular rotor.

6. A circuit breaker with an electrical overcurrent tripping device comprising:

at least one contact point with a fixed contact piece and a movable contact piece, wherein said tripping device includes an actuating member which in case of an overcurrent is driven to interact directly or indirectly with the movable contact piece to open the contact point if said overcurrent exceeds a preset tripping threshold for a predetermined tripping delay time, wherein said actuating member is coupled to a magnetic circuit such that the driving force acting on the actuating member is created by the magnetic field of the overcurrent, said actuating member is coupled to an electromagnetic damping arrangement to set the tripping delay time, and said actuating member is connected to a coupling spring configured to adjust the overcurrent tripping threshold, wherein said actuating member is an electromagnetically damped rotor in a magnetic circuit where the driving magnetic field is created by the load current, wherein the magnetic circuit includes a tubular stator as part of the magnetic core of the magnetic circuit with at least one winding of a conductor embracing the magnetic core and carrying at least partly the load current, and wherein the stator at least partially embraces the rotor and the rotor is rotatably mounted within the stator.

7. An electrical overcurrent tripping device for a circuit breaker, comprising:

a magnetic circuit for generating a magnetic field induced by an overcurrent; and an actuating member driven by the magnetic field of the magnetic circuit, wherein said actuating member interacts with a movable contact piece of the circuit breaker to open a contact point in the circuit breaker if the overcurrent exceeds a preset tripping threshold for a predetermined tripping delay time;

an electromagnetic damping arrangement coupled to the actuating member to set the tripping delay time; and a coupling spring connected to said actuating member for adjusting the overcurrent tripping threshold, wherein said actuating member is an electromagnetically damped tubular rotor having a permanent magnet in a magnetic circuit where the driving magnetic field is created by the load current, wherein said magnetic circuit includes a tubular stator as part of the magnetic core of the magnetic circuit with at least one winding of a conductor embracing the magnetic core and carrying at least partly the load current, and wherein said stator at least partially embraces the rotor and the rotor is rotatably mounted within the stator.

8. The electrical overcurrent tripping device according to claim 7, wherein the tubular stator comprises soft magnetic and highly permeable material, and has radially oriented slots to control the magnetic flux.

9. The electrical overcurrent tripping device according to claim 7, wherein the device comprises an eddy-current type electromagnetic damping system for the rotor.

10. The electrical overcurrent tripping device according to claim 9, wherein the electromagnetic damping arrangement comprises a tube made of electrically conductive material located in a gap between the tubular stator and the tubular rotor, so that a damping power loss due to eddy-current generated in the tube is induced when the rotor is turning.

11. The electrical overcurrent tripping device according to claim 9, wherein the coupling spring is coupled to the rotation axis of the tubular rotor.

* * * * *